US006291947B1

(12) United States Patent
Koeppl et al.

(10) Patent No.: US 6,291,947 B1
(45) Date of Patent: Sep. 18, 2001

(54) CIRCUIT ARRANGEMENT FOR OPERATING AT LEAST ONE DISCHARGE LAMP

(75) Inventors: Richard Koeppl, Saaldorf; Olaf Busse; Martin Grabner, both of Munich, all of (DE)

(73) Assignee: Patent-Treuhand-Gelsellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/644,041

(22) Filed: Aug. 23, 2000

(30) Foreign Application Priority Data

Aug. 30, 1999 (DE) ..... 199 41 437

(51) Int. Cl.[7] ..... G05F 1/00

(52) U.S. Cl. ..... 315/307; 315/224; 315/283; 315/287; 315/DIG. 2; 315/DIG. 5

(58) Field of Search ..... 315/200 R, 224, 315/225, 209 T, 209 CD, 283, 287, 291, 307, DIG. 2, DIG. 5, DIG. 7

(56) References Cited

U.S. PATENT DOCUMENTS 5,493,182 * 2/1996 Sowa et al. ..... 315/307
5,677,602 * 10/1997 Paul et al. ..... 315/224
5,770,925 * 6/1998 Konopka et al. ..... 315/225
5,869,937 * 2/1999 Konopka ..... 315/209 CD
5,994,847 * 11/1999 Konopka ..... 315/DIG. 7
6,177,768 * 1/2001 Kamata et al. ..... 315/291

FOREIGN PATENT DOCUMENTS 196 19 580 11/1997 (DE) .

* cited by examiner

*Primary Examiner*—Don Wong
*Assistant Examiner*—Thuy Vinh Tran
(74) *Attorney, Agent, or Firm*—Carlos S. Bessone

(57) ABSTRACT

The invention relates to a circuit arrangement for operating at least one discharge lamp, which has a half-bridge inverter (T1, T2, A) with a downstream load circuit (LD, CR) and has a half-bridge capacitor (CK) and also a monitoring apparatus for monitoring a change in the voltage drop across the half-bridge capacitor (CK) which is caused by the occurrence of a rectifying action in the at least one discharge lamp LP. According to the invention, the monitoring apparatus has a first RC element (R1, C1) and a second RC element (R2, C2), which are connected to one another by a threshold switch (DC), and means for detecting the switching state of the threshold switch (DC). The first RC element (R1, C1) is connected to the center tap of the half-bridge inverter, and the second RC element (R2, C2) is connected to the half-bridge capacitor (CK).

7 Claims, 1 Drawing Sheet

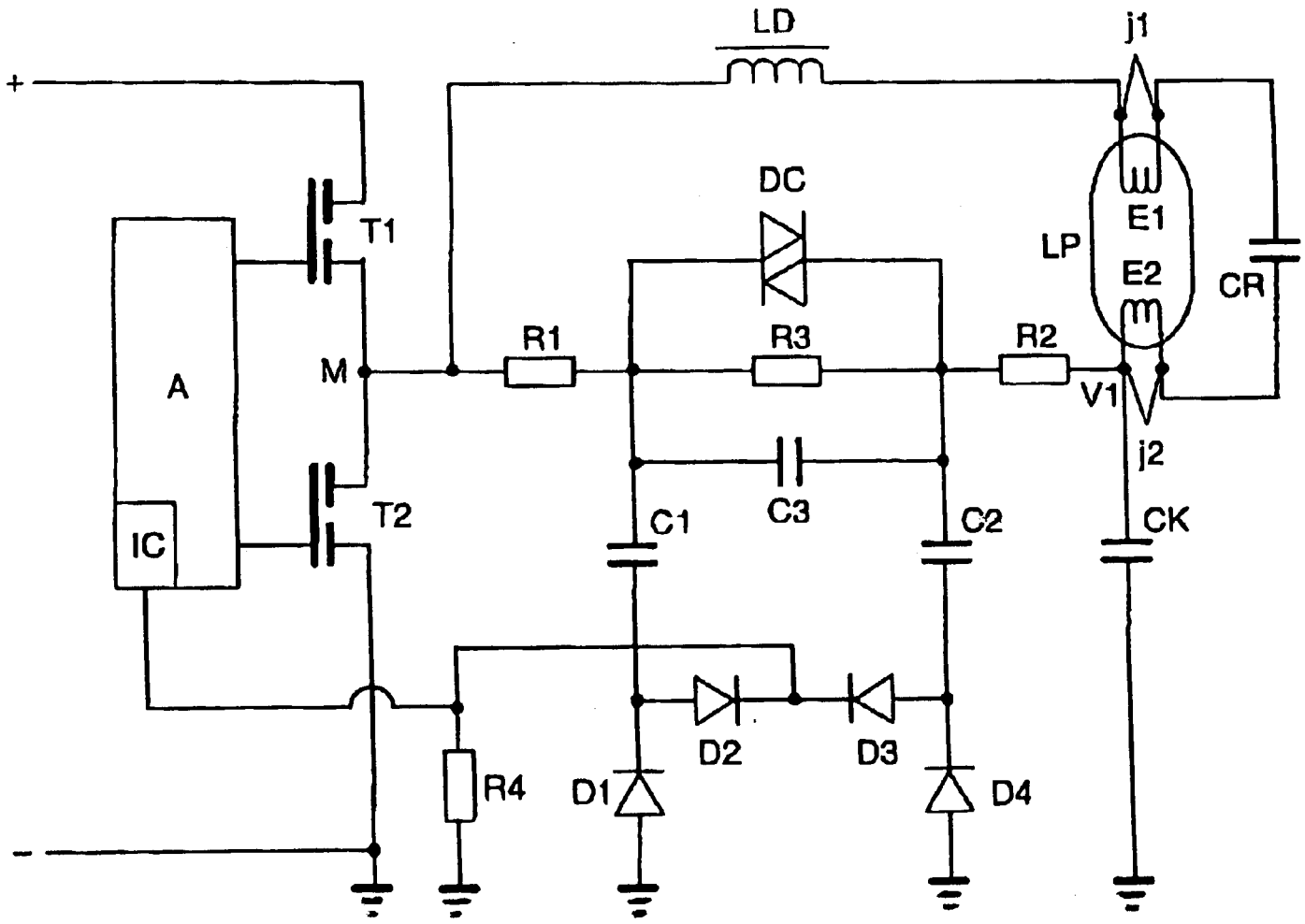
CR
j1
E1
E2
j2
CK
V1
LP
R2
C2
D4
D3
LD
DC
R3
C3
D2
C1
D1
R1
R4
T1
M
T2
A
IC
+
-

CIRCUIT ARRANGEMENT FOR OPERATING AT LEAST ONE DISCHARGE LAMP

I. PRIOR ART

Such a circuit arrangement is disclosed, for example, in German Laid-Open Specification DE 196 19 580. This document describes a safety disconnection device for a half-bridge inverter, said safety disconnection device detecting the occurrence of a rectifying action in the discharge lamp and disconnecting the half-bridge inverter in this case. The safety disconnection device is designed such that it responds to a DC voltage across the half-bridge capacitor which is caused by a DC component of the lamp current. This is because the occurrence of a pronounced rectifying action in the discharge lamp marks the end of the useful life of the discharge lamp and causes a voltage drop across the half-bridge capacitor which is different from the nominal value—that is to say from half the intermediate circuit voltage. This comparatively complex safety disconnection device comprises a threshold switch and a bistable multivibrator which can be used to remove the drive signal from a half-bridge inverter transistor.

II. ILLUSTRATION OF THE INVENTION

The object of the invention is to provide, for a circuit arrangement of this generic type, an improved apparatus for detecting a rectifying action occurring in the at least one discharge lamp.

The invention achieves this object by means of the characterizing features of Patent claim 1. Particularly advantageous embodiments of the invention are described in the dependent claims.

To monitor the voltage drop across the half-bridge capacitor, the circuit arrangement according to the invention has a first and a second RC element, which are connected to one another by a threshold switch, and means for detecting the switching state of the threshold switch. The first RC element is connected to the center tap of the half-bridge inverter, and the second RC element is connected to the half-bridge capacitor. This means that a DC voltage develops across the capacitor in the first RC element, said DC voltage being equivalent to half the intermediate circuit voltage, that is to say to half the supply voltage of the half-bridge inverter, while a DC voltage develops across the capacitor in the second RC element which is equivalent to the voltage drop across the half-bridge capacitor. The high-frequency voltage components are filtered out of the half-bridge capacitor voltage by the second RC element. During fault-free lamp operation, the aforementioned DC voltages are of approximately the same size, so that there is no significant potential difference between the two RC elements. If a rectifying action occurs in the at least one discharge lamp, then the voltage drop across the half-bridge capacitor changes, as does the DC voltage across the capacitor in the second RC element, accordingly. If the potential difference between the capacitors in the two RC elements reaches the threshold voltage of the threshold switch, then said threshold switch is switched to the conductive state and a current flows between the two aforementioned capacitors in order to equalize their different charge state. The switching state of the threshold switch or the flow of current between the capacitors in the two RC elements is detected by the drive apparatus in the half-bridge inverter using suitable means, so that the half-bridge inverter can be disconnected in a fault situation.

The circuit arrangement according to the invention advantageously has a nonreactive resistor which is arranged in parallel with the threshold switch and forms a voltage divider with the resistors in the first and second RC elements. Using this additional resistor, the switching threshold of the monitoring circuit according to the invention can, with suitable dimensioning of the aforementioned resistors, be set to any desired voltage value above the threshold voltage of the threshold switch. In addition, the circuit arrangement according to the invention advantageously has a capacitor which is arranged in parallel with the threshold switch and holds the threshold switch, once it has been switched on, in the conductive state sufficiently long to ensure that the charges in the capacitors in the first and second RC elements are equalized. The threshold switch used is advantageously a diac, since this reacts both to positive and to negative voltages. To detect the switching state of the threshold switch, the monitoring circuit according to the invention advantageously has a further nonreactive resistor, through which the current equalizing the different charges in the capacitors in the two RC elements flows. A rectifier is advantageously connected upstream of this resistor, so that the aforementioned equalization current between the capacitors in the RC elements produces unipolar voltage pulses across the resistor whose polarity is independent of the direction of flow of the equalization current. These unipolar voltage pulses can be used by the monitor input of an integrated circuit in order to disconnect the half-bridge inverter.

The monitoring circuit according to the invention may advantageously be used for separately controlled half-bridge inverters. It is also distinguished by the fact that it is not susceptible to faults, because, with the exception of the resistor through which the equalization current flows, all the components of the monitoring circuit according to the invention are arranged in the high-voltage part of the circuit arrangement, and the signal line from the rectifier to the resistor through which the equalization current flows is terminated at low resistance by said resistor.

III. DESCRIPTION OF THE PREFERRED ILLUSTRATIVE EMBODIMENT

The invention is explained in more detail below with the aid of a preferred illustrative embodiment. The figure shows a schematic illustration of the circuit arrangement according to the preferred illustrative embodiment.

The circuit arrangement according to the preferred illustrative embodiment is a separately controlled half-bridge inverter for high-frequency operation of a fluorescent lamp LP. The half-bridge inverter has two alternately switching field-effect transistors T1, T2 and a drive apparatus A for these transistors T1, T2. The drive apparatus A is partly in the form of an integrated circuit IC, in particular a high-voltage IC. The DC voltage supply for the half-bridge inverter is obtained from the mains AC voltage by rectification, in the customary manner. Arranged between the center tap M of the half-bridge inverter and the tap V1 on the half-bridge capacitor CK is a load circuit which is in the form of a series resonant circuit and is essentially formed by the lamp inductor LD and the ignition capacitor CR. In addition, the load circuit has two pairs of electrical connections j1, j2 for the electrode coils E1, E2 of a fluorescent lamp LP. The fluorescent lamp LP is connected in parallel with the ignition capacitor CR. In addition, the circuit arrangement can have a heating apparatus (not shown) for preheating the electrode coils E1, E2 of the fluorescent lamp LP. The circuit arrangement is also equipped with a monitoring circuit which has a first RC element R1, C1 and a second RC element R2, C2, and also a diac DC. The first RC element R1, C1 is connected to the center tap M of the half-bridge inverter, while the second RC element R2, C2 is connected to the tap V2 of the half-bridge capacitor CK. The capacitors C1, C2 in the two RC elements R1, C1, R2, C2 are connected to one another by the diac DC. Connected in parallel with the diac DC is a nonreactive resistor R3 which forms a voltage divider with the resistors R1, R2 in the RC elements. In addition, the monitoring circuit has a capacitor C3 in parallel with the diac DC and in parallel with the resistor R3, said capacitor C3 holding the diac DC in the conductive state for longer after it has turned on. The ground-side connections of the capacitors C1, C2 are connected to a rectifier comprising four diodes D1, D2, D3, D4. The DC voltage output of the rectifier D1, D2, D3, D4 is connected to ground via a low-value resistor R4. The voltage drop across the resistor R4 is monitored by the drive apparatus A in the half-bridge inverter via a connecting line between the resistor R4 and a monitor input of the integrated circuit IC.

Once the circuit arrangement has been switched on, the half-bridge capacitor CK is charged, so that the tap V1 is at an electrical potential which is equivalent to half the supply voltage of the half-bridge inverter. The alternately switching transistors T1, T2 in the half-bridge inverter apply a high-frequency AC voltage between approximately 30–50 kHz to the load circuit. The capacitors C1 and C2 in the two RC elements R1, C1 and R2, C2 are charged, so that they have a DC voltage which is the same as half the intermediate circuit voltage, that is to say the same as half the supply voltage of the half-bridge inverter. In this case, the high-frequency AC components are filtered out by the capacitors C1, C2. A heating apparatus (not shown) can be used to preheat the electrode coils E1, E2 in the fluorescent lamp. The resonance step-up method is used to provide the ignition capacitor CR with the ignition voltage required to ignite a gas discharge in the fluorescent lamp LP. Once a gas discharge has formed between the electrode coils E1, E2 in the fluorescent lamp LP, the ignition capacitor CR is bridged by the discharge path. A high-frequency alternating current regulated to a constant level by the half-bridge inverter flows through the fluorescent lamp LP. Ideally, the lamp current is symmetrical with respect to the two half-periods of the high-frequency AC voltage, so that the potential at the tap V1 continues to be equivalent to half the supply voltage of the half-bridge inverter. This means that, normally, no or at least no significant voltage drop can be measured across the resistor R3, the charge state of the capacitors C1, C2 is approximately the same and the diac DC is turned off.

If a rectifying action occurs in the fluorescent lamp LP, which results in a preferential direction developing for the lamp current, then the voltage drop across the half-bridge capacitor CK is increased or reduced depending on which half-cycle of the lamp current is let through as a preference by the fluorescent lamp LP. The potential at the tap V1 is accordingly increased or reduced, and the capacitor C2 in the second RC element has its charge reversed as appropriate. As a result, an accordingly altered potential difference develops between the taps M and V1, divided between the resistors R1, R2, R3 in the ratio of the resistance values. If the voltage drop across the resistor R3 reaches the threshold voltage of the diac DC, which in the present case is ±32 V, then the diac DC turns on. A current equalizing the different charges in the capacitors C1, C2 then flows either via the diode D3 or via the diode D2 and through the diac DC and also through the resistor R4. The diac DC switches to the off state again only when its holding current is undershot. The capacitor C3 arranged in parallel with the diac DC is dimensioned such that it holds the diac DC in the conductive state sufficiently long to ensure complete equalization of the charges in the capacitors C1, C2. After charge equalization has taken place between the capacitors C1, C2 and the diac DC has switched to the off state again, a voltage develops across the capacitor C2 again which is equivalent to half the intermediate circuit voltage plus the shift in potential, caused by the rectifying action, on the tap V1. As soon as the threshold voltage of the diac DC has developed across the resistor R3 again, the diac DC is switched to the conductive state again and charge equalization again takes place between the capacitors C1, C2. This process is repeated cyclically. The time interval for the capacitors' charge equalization described above, and hence also the time interval between the current pulses through the diac DC, depend on the intensity of the rectifying action. The larger this potential difference is, the shorter the time interval between the current pulses. Or in other words, the greater the difference between the voltage across the half-bridge capacitor CK and half the intermediate circuit voltage, the shorter the intervals between the current pulses. The low-value resistor R4 and the bridge rectifier D1, D2, D3, D4 convert these current pulses causing the charge equalization between the capacitors C1, C2 into unipolar voltage pulses of positive polarity. These voltage pulses generated on the resistor R4 are supplied to a monitor input of the integrated circuit IC in the drive apparatus A in the half-bridge inverter. The drive apparatus A is programmed such that it disconnects the half-bridge inverter after an input voltage has been detected at the aforementioned monitor input.

Table I indicates dimensions for the components in the monitoring apparatus of the circuit arrangement according to the invention, which is suitable for operating one or more series-connected fluorescent lamps and for a lamp current of 170 mA.

The invention is not restricted to the illustrative embodiment explained above in more detail. By way of example, the monitoring apparatus according to the invention may also be used in circuit arrangements used for operating a plurality of series-connected or parallel-connected discharge lamps. The circuit arrangement according to the invention is suitable not only for operating fluorescent lamps, but may also be used generally for operating low-pressure discharge lamps. In addition, the monitoring apparatus according to the invention can be used not only for separately controlled half-bridge inverters, but also for free-running half-bridge inverters. In addition, the drive apparatus A in the half-bridge inverter can also be designed such that it reacts suitably to the voltage pulses on the resistor R4. By way of example, the drive apparatus A can be designed such that it disconnects the half-bridge inverter only from a particular, prescribed pulse frequency of the voltage pulses detected on the resistor R4.

TABLE I

Dimensions of the components in the monitoring apparatus according to the invention for a circuit arrangement regulating the lamp current to a value of 170 mA

| | |
|---|---|
| R1, R2 | 100 kΩ, 10%, 500 V |
| R3 | 390 kΩ, 5% |
| R4 | 150 Ω |
| C1, C2 | 10 nF, 250 V, RM 7.5 |
| C3 | 47 nF, 50 V |

TABLE I-continued

| Dimensions of the components in the monitoring apparatus according to the invention for a circuit arrangement regulating the lamp current to a value of 170 mA | |
|---|---|
| D1, D2, D3, D4 | Diode SMD, 75 V-150 mA SOD80 |
| DC | Diac, 32 V |

What is claimed is:

1. Circuit arrangement for operating at least one discharge lamp, the circuit arrangement having the following features:

a half-bridge inverter (T1, T2, A) having a drive apparatus (A) and having a downstream load circuit (LD, CR, j1, j2), at least one half-bridge capacitor (CK) connected to the load circuit and to the half-bridge inverter, the load circuit (LD, CR, j1, j2) having electrical connections (j1, j2) for at least one discharge lamp (LP), and means for monitoring the voltage drop across the at least one half-bridge capacitor (CK), characterized in that the means for monitoring the voltage drop across the half-bridge capacitor (CK):

have a first RC element (R1, C1) and a second RC element (R2, C2), which are connected to one another by a threshold switch (DC), the first RC element (R1, C1) being connected to the center tap (M) of the half-bridge inverter (T1, T2, A), and the second RC element (R2, C2) being connected to the half-bridge capacitor (CK), and have means for detecting the switching state of the threshold switch (DC).

2. The circuit arrangement according to claim 1, characterized in that the means for detecting the switching state of the threshold switch (DC) has a nonreactive resistor (R4) which detects the flow of current through the threshold switch (DC).

3. The circuit arrangement according to claim 2, characterized in that a rectifier (D1–D4) is connected upstream of the nonreactive resistor (R4).

4. The circuit arrangement according to claim 3, characterized in that the drive apparatus (A) in the half-bridge inverter (T1, T2, A) has an integrated circuit (IC) with a monitor input, the monitor input being connected to the nonreactive resistor (R4) detecting the flow of current through the threshold switch (DC).

5. The circuit arrangement according to claim 1, characterized in that the threshold switch (DC) has a nonreactive resistor (R3) connected in parallel with it, said nonreactive resistor forming a voltage divider with the resistors (R1, R2) in the first RC element (R1, C1) and the second RC element (R2, C2).

6. The circuit arrangement according to claim 1, characterized in that the threshold switch (DC) has a capacitor (C3) connected in parallel with it.

7. The circuit arrangement according to claim 1, characterized in that the threshold switch (DC) is a diac.

* * * * *